US008677794B2

(12) United States Patent
Cernuschi et al.

(10) Patent No.: US 8,677,794 B2
(45) Date of Patent: Mar. 25, 2014

(54) MULTI-STAND ROLLING MILL OF THE LONGITUDINAL ELONGATOR KIND FOR ROD-SHAPED BODIES, COMPRISING FOUR-ROLLS STANDS, AND METHOD FOR SUBSTITUTING THE STANDS

(75) Inventors: Ettore Cernuschi, Bareggio (IT); Aristide Giacomo Bertelli, Bresso (IT); Gerhard Kulessa, Muelheim/Ruhr (DE)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 158 days.

(21) Appl. No.: 13/138,050

(22) PCT Filed: Dec. 28, 2009

(86) PCT No.: PCT/EP2009/067961

§ 371 (c)(1),
(2), (4) Date: Aug. 3, 2011

(87) PCT Pub. No.: WO2010/076308

PCT Pub. Date: Jul. 8, 2010

(65) Prior Publication Data

US 2011/0277527 A1 Nov. 17, 2011

(30) Foreign Application Priority Data

Dec. 30, 2008 (IT) ..... MI2008A2343

(51) Int. Cl.
*B21B 13/12* (2006.01)

(52) U.S. Cl.
USPC ..... 72/235; 72/238; 72/239

(58) Field of Classification Search
USPC ..... 72/224, 225, 234, 235, 237, 238, 239, 72/249
See application file for complete search history.

(56) References Cited

U.S. PATENT DOCUMENTS

| | | | | | |
|---|---|---|---|---|---|
| 3,221,529 | A * | 12/1965 | Chang | ..... | 72/224 |
| 3,665,746 | A * | 5/1972 | Eibe | ..... | 72/239 |
| 3,712,102 | A * | 1/1973 | Eibe | ..... | 72/238 |
| 4,274,274 | A * | 6/1981 | Zacharias et al. | ..... | 72/239 |
| 5,363,682 | A | 11/1994 | Takeda et al. | | |
| 6,128,939 | A * | 10/2000 | Fay et al. | ..... | 72/235 |
| 2003/0217579 | A1 * | 11/2003 | Bindernagel et al. | ..... | 72/239 |

FOREIGN PATENT DOCUMENTS

| | | | | |
|---|---|---|---|---|
| CN | 1032125 | | 4/1989 | |
| DE | 3237904 | A1 * | 4/1984 | ..... B21B 31/08 |
| DE | 100 15 285 | | 10/2001 | |
| EP | 0 865 836 | | 9/1998 | |
| JP | 07-009010 | | 1/1995 | |

* cited by examiner

*Primary Examiner* — Edward Tolan
(74) *Attorney, Agent, or Firm* — Stetine Brunda Garred & Brucker

(57) ABSTRACT

There is described multi-stand rolling mill with stands having four motorized rolls and provided with controls outside the stand and retractile spindles, which comprises a central body with said stands; a first platform (41) on a side charge position carrying the substitution stands; a second platform (42) on a side discharge position, opposite to said side charge position; a transversal translation device (43, 44) adapted to push the substitution stands against the corresponding stands to be substituted on the central body. The stands to be substituted translate on the second platform, and the substitution stands substitute the stands to be substituted in the central body.

16 Claims, 9 Drawing Sheets

MULTI-STAND ROLLING MILL OF THE LONGITUDINAL ELONGATOR KIND FOR ROD-SHAPED BODIES, COMPRISING FOUR-ROLLS STANDS, AND METHOD FOR SUBSTITUTING THE STANDS

FIELD OF THE INVENTION

The present invention relates to a multi-stand rolling mill of the longitudinal elongator kind for rod-shaped bodies, comprising stands having four motorized rolls, and a method for substituting the stands.

STATE OF THE ART

It is known that the longitudinal rolling of rod-shaped bodies, in particular of tubes or rods, is carried out by means of multi-stand rolling mills having motorized rolls, in which each stand is provided with two or three rolls, and the position of said rolls may be advantageously adjusted by changing the distance of the roll itself from the rolling axis, in order to change the rolling conditions and the reductions at each stand.

On the other hand, machines of this type may have a high number of stands (higher than 15-16, up to 32 stands), of considerable length (e.g. 10-12 m), with a small minimum distance between axes in order to minimize the head and tail parts of rod-shaped bodies, which should be rejected, because they are not subjected to constant rolling conditions when the rolling mill works on different rolling parts, i.e. the head, body and tail of the material being rolled.

In two-roll-stand rolling mills, the sequence of stands is offset by 90° so that the roll gaps correspond to the bottom gorge of the successive stands. In three-roll mills, the offset is 60°. The known types have complex roll controls because of the need to insert a high number of motors and corresponding accessories.

In three-roll-stand rolling mills of this type, the radial rolling forces are normally confined within the stand, unlike rolling mills for tubes which operate on an inner tool.

A series of needs (listed below) suggest the use of four-roll stands.

- Greater peripheral speed uniformity on the roll groove (of the bottom gorge with respect to the gorge ends) with respect to three-roll stands, because the relevant sector of each roll passes from 120° (for the three-roll stands) to 90°. A greater feeding effect is obtained, the number of stands being equal.
- Less pinching (crushing) effect of the edges of the roll on the rod-shaped body, as compared to a three-roll stand, because the two rotation axes of the two adjacent rolls are at 90° and not at 120°. Indeed, on the basis of this effect in the rolling process, the rod-shaped material tends to fit the spaces between the rolls.

On the other hand, a four-roll-stand rolling mill implies a series of problems which are difficult to be solved. The number of auxiliary components needed and thus the manufacturing cost are increased. The space required to install the rolling mill in an industrial shed also increases.

Furthermore, several necessary operations are more difficult, such as the operations for substituting the stands while rolling, which requires a long time and a series of manual operations, and for rotating the rolls to prevent the misalignment between successive rolls, which would risk causing scoring phenomena on the rod-shaped body.

A further problem consists in that a four-roll-stand rolling mill has the difficulty of offsetting the two successive stands by 45°, such a condition makes it difficult to practically implement the structure of the rolling mill and roll/stand change.

Rolling mills provided with four-roll stands are known in the art, in which two rolls are motorized and two are idle, such as described in patent EP-0865836, for example, especially used for rolling processes having a diameter variation or a void reduction. This type of stands may not be used universally because the idle rolls do not exert any pulling action.

SUMMARY OF THE INVENTION

It is therefore the object of the present invention to suggest a multi-stand rolling mill of the longitudinal elongator kind, for rod-shaped bodies, comprising stands having four motorized rolls, and a method for substituting the stands adapted to overcome all the aforesaid drawbacks.

In accordance with claim 1, it is the object of the present invention a multi-stand rolling mill of the longitudinal elongator kind, for rod-shaped bodies, comprising four-roll stands, wherein said four rolls are motorized and provided with spindles, said rolling mill comprising:

- a central body comprising a sequence of said stands for said rolling;
- a first platform on a first side charge position, carrying or more substitution stands;
- a second platform on a side discharge position, opposite to said side charge position, said second platform being adapted to carry said one or more stands to be substituted;
- a transverse translation device acting on said one or more substitution stands to push them against corresponding stands to be substituted on the central body; said stands to be substituted translating on said second platform, and said one or more substitution stands substituting said one or more stands to be substituted in said central body.

It is another object of the present invention a method for substituting the stands in a multi-stand rolling mill as defined above, comprising the steps of:

- prearranging on said first platform said one or more substitution stands, in correspondence to one or more stands to be substituted on the central body;
- unlocking said spindles and backing them so that the end part close to the rolls protrudes from the edge of the corresponding stand;
- transversally translating said one or more substitution stands pushing them against said one or more stands to be substituted, so that said one or more substitution stands are placed on said second platform and said one or more substitution stands are placed in the central body;
- locking again said spindles, thus restarting the rolling process.

It is a particular object of the present invention a multi-stand rolling mill of the longitudinal elongator kind, for rod-shaped bodies, comprising stands having four motorized rolls, and a method for substituting the stands as described in greater detail in the claims, which form an integral part of the present description.

BRIEF DESCRIPTION OF THE DRAWINGS

Further objects and advantages of the present invention will be apparent from the following detailed description of an embodiment thereof along with the accompanying drawings, provided by way of mere non-limitative example, in which.

The same reference numbers and letters in the figures refer to the same elements or components.

DETAILED DESCRIPTION OF A PREFERRED EMBODIMENT OF THE INVENTION

Figure 1:
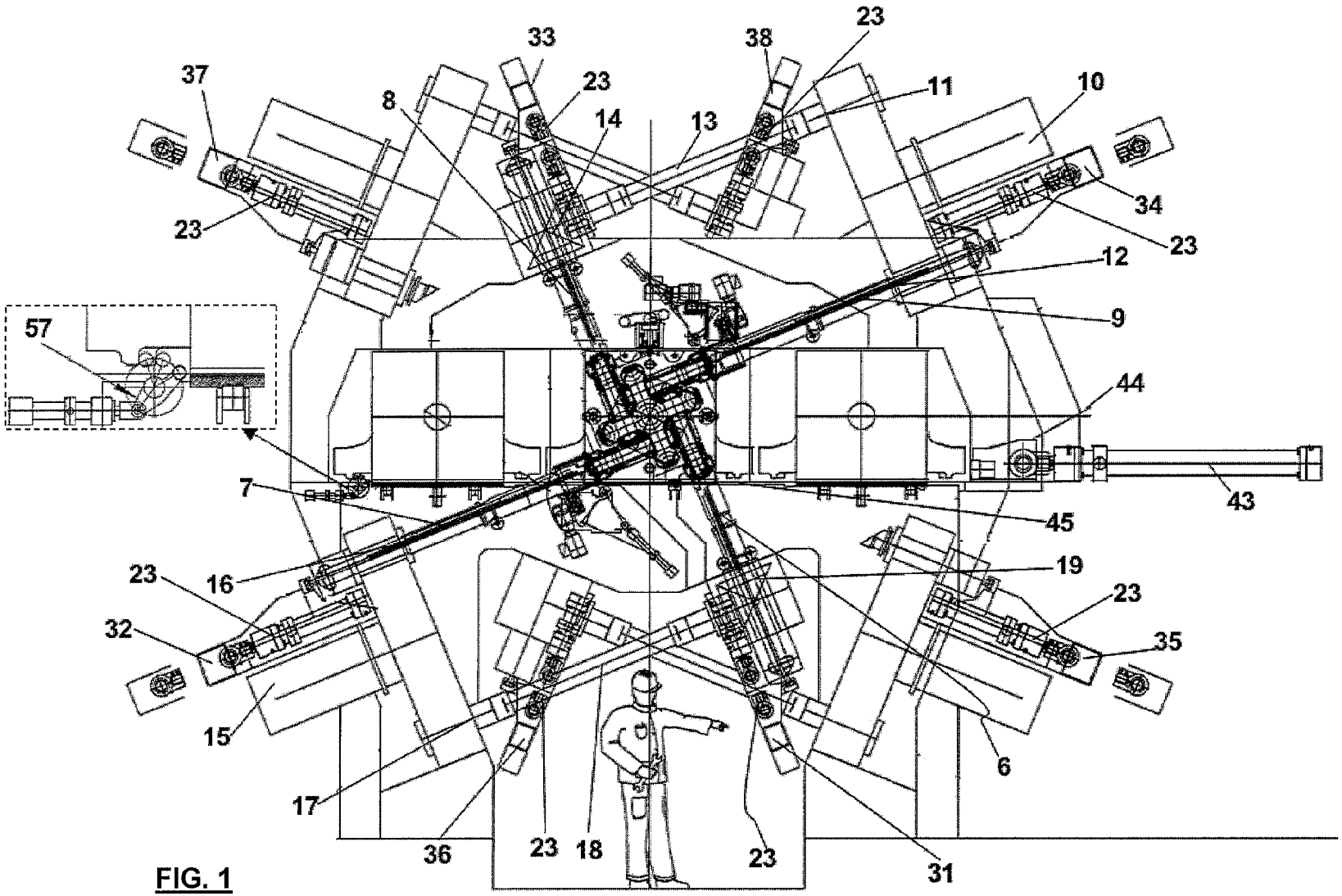
FIGS. 1, 2, 3 show side section views of a stand in accordance with the invention.
Figure 2:
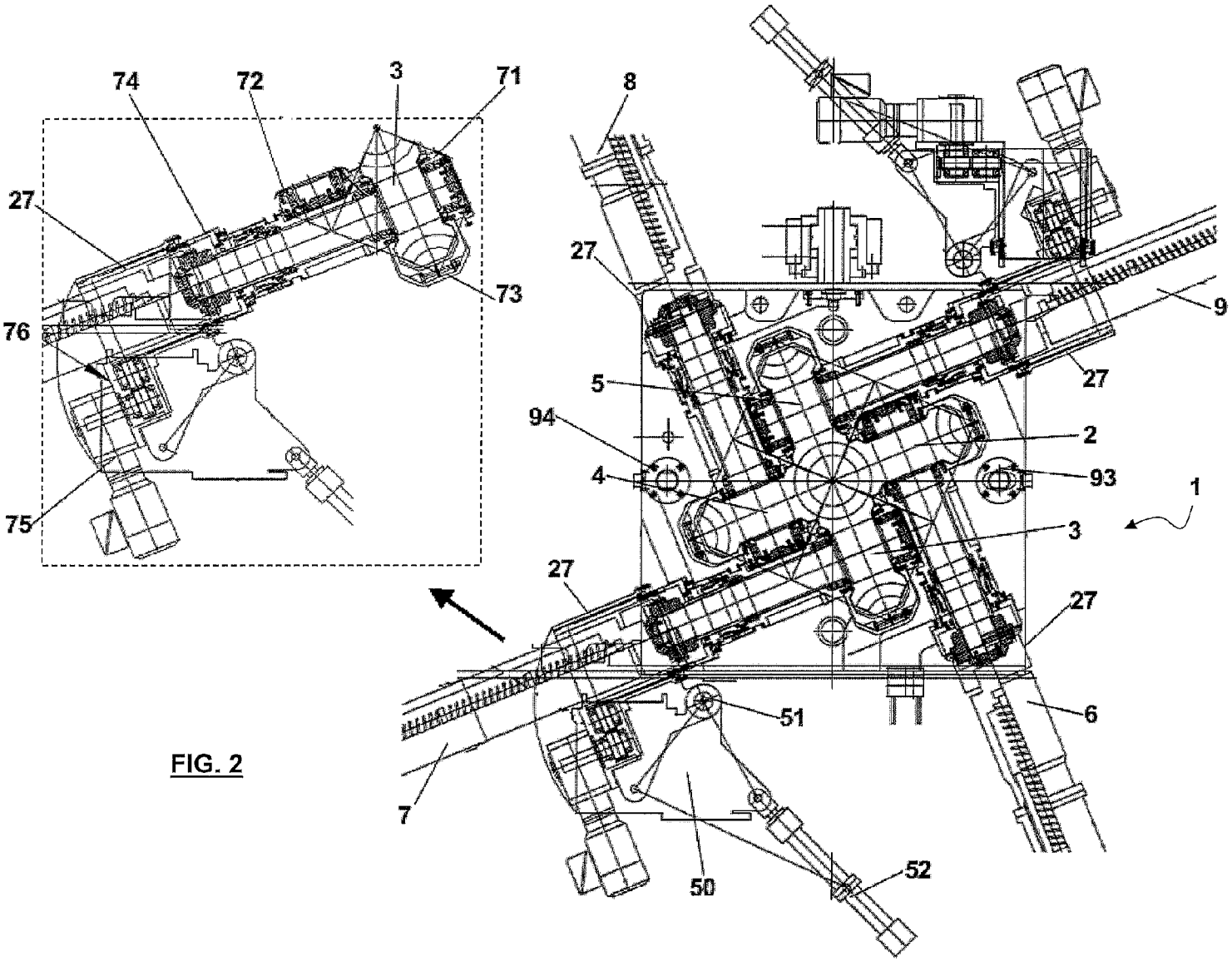
Figure 3:
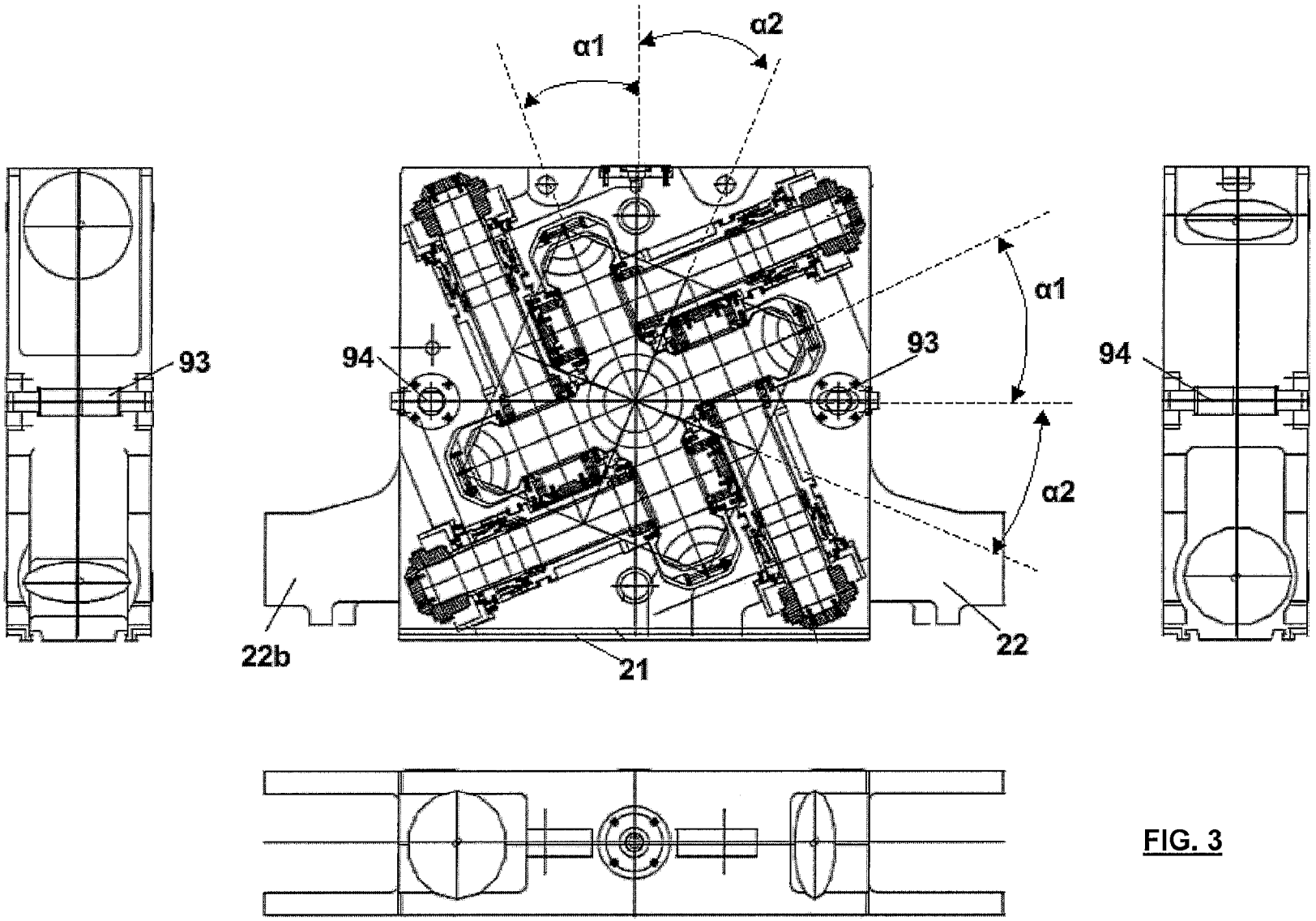

With particular reference to FIGS. 1, 2 and 3, a stand 1 in accordance with an aspect of the present invention comprises four rolls 2, 3, 4 and 5, each of which is provided with a corresponding control spindle, 6, 7, 8, and 9, respectively.

All rolls are motorized, but two neighbouring rolls are controlled by means of a single motor with appropriate motion transmission linkages.

The total number of the motors is thus double the number of the stands. In particular, rolls 4 and 5 are controlled by means of the motor 10, which is connected to a splitter reducer with two outputs 11, 12: output 12 directly controls the spindle 9, while output 11 controls the spindle 8 by means of the spindle 13 and the 90° transmission 14.

Similarly, rolls 2 and 3 are controlled by means of the motor 15, which is connected to a splitter reducer with two outputs 16, 17: the output 16 directly controls the spindle 7, while the output 17 controls the spindle 6 by means of the spindle 18 and the 90° transmission 19.

In the rolling mill, the sequence of stands is such that the stand adjacent to the one shown in the figure has similar components but is overturned with respect to the vertical axis, the stands being symmetric to this axis.

Therefore, a stand may be mechanically equal to the next one because two successive stands may be obtained by a rigid 180° rotation of the stand about the vertical axis passing through the rolling axis.

More in particular, the axis of each roll of a stand is rotated by an angle $\alpha 1=-22.5°$ with respect to the reference vertical or horizontal axis, whereas the axis of each roll of the successive stand is rotated by an opposed angle $\alpha 2=22.5°$.

The roll controls, i.e. reducers and motors, are thus arranged on four rows having angles of +/−22.5° with respect to the horizontal plane. The axes of rolls and controls are thus offset by 45° on successive stands. The stands with angle $\alpha 1$ may also be defined in an odd position in the rolling mill, while those with angle $\alpha 2$ may be defined in an even position, or vice versa.

The vertical and horizontal planes are referred to the laying plane of the stands on the rolling mill.

The four rolls controlled by each stand are coplanar.

Furthermore, the bottom gorges of the four rolls of a stand are aligned with the roll gaps of the successive stand.

With this arrangement, the space along the axis of the rolling mill for motors and reducers is a double step, because the motors and reducers of the even and odd stands are offset and thus not aligned.

In the rolling mills of this type, the radial rolling forces are normally confined within the stand, unlike the tube rolling mills which operate on an internal tool, this simplifies the construction of the external structure in which stand blocking and aligning system, but not adjustable systems adapted to support the radial rolling forces should be provided.

By virtue of these solutions, four-roll stands may be used thus obtaining a compact, small-sized stand structure both in height and in width. A better feeding action is obtained due to the presence of a higher number of rolls, each having a circular 90° sector, as compared to three-roll stands of known type, having 120° sectors.

The arrangement of the spindles exiting the reducers at +/−22.5° with respect to the horizontal allows to obtain the further advantage of a better action of cooling water draining.

The peripheral speed uniformity on the roll groove (of the bottom gorge with respect to the gorge ends) is surely better than that of a three-roll-stand rolling mill because the respective sector of each roll passes from 120° (for three-roll stands) to 90°. The rolls feed better, and therefore the performance of the rolling mill itself may be increased.

The pinching (crushing) effect of the edges of the roll on the rod-shaped body is reduced, with respect to a three-roll stand, because the two rotation axes of two adjacent rolls are at 90° and not at 120°. Indeed, on the basis of this effect in the rolling process, the rod-shaped material tends to fit the spaces between the rolls.

Furthermore, when rolling thick tubes, the inner shape of the tube is improved by reducing the effect known as inner tube poligonality.

The spindles are of the releasable, retractile type. For this purpose, their outer ends are connected to longitudinal beams (in the direction of the rolling mill axis):

there is one beam for each row of spindles arranged at the same angle on different stands. There are four beams 31, 32, 33, 34 for the stands arranged with angle $\alpha 1$, and an equal number of beams 35, 36, 37, 38 for the stands with angle $\alpha 2$.

The ends of the spindles towards the rolls are connected by means of tooth joints of known type which allow to release the half-joint integrally mounted at the end of the roll.

The longitudinal beams simultaneously act on the corresponding row spindles by means of hydraulic controls 23, and determine the backing of the spindles so that the end part thereof towards the rolls overhangs from the edge of the stand.

Hydraulic controls 23 act on the beams 31, 32, 33, 34, 35, 36, 37, 38 and from there on the internal tie rods coaxial to the spindle themselves.

With reference to FIG. 3, the roll-holder stands have a substantially square structure with a lower horizontal side 21.

Furthermore, on the lower side, there are external extensions 22, 22*b*, according to the stand extension needed for the stand substitution operations. The shape of the lower side of the stand is symmetric with respect to the vertical axis, whereby the same stand may take either even or odd positions in the rolling mill, being sufficient to rotate it by 180° about the vertical axis: the lower side 21 is kept. Thereby, the off-line operations of preparing the stand are greatly simplified, because it is sufficient to raise it, rotate it on itself, being thus able to use the same type of stand in successive positions.

In the known three-roll rolling mills, the tipping of the stands occurs with respect to a horizontal axis, which is surely more inconvenient from the operative practical point of view.

The stand structure described above is particularly simple and the stand substituting process is fast. It is worth noting that in this type of rolling mills, stand substitution is normally of partial type, i.e. there is normally the need to substitute only some stands towards the outlet side, upon the change of the outlet size of the rod-shaped body to the machined.

It is further worth noting for completeness, that in these rolling mills, as known, dummy stands may be present downstream of the last rolling stand, which dummy stands are provided with tube supporting and handling systems, these dummy stands being morphologically similar to the stands themselves because they should be placed and locked in the rolling mill as if they were real rolling stands.

Figure 4:
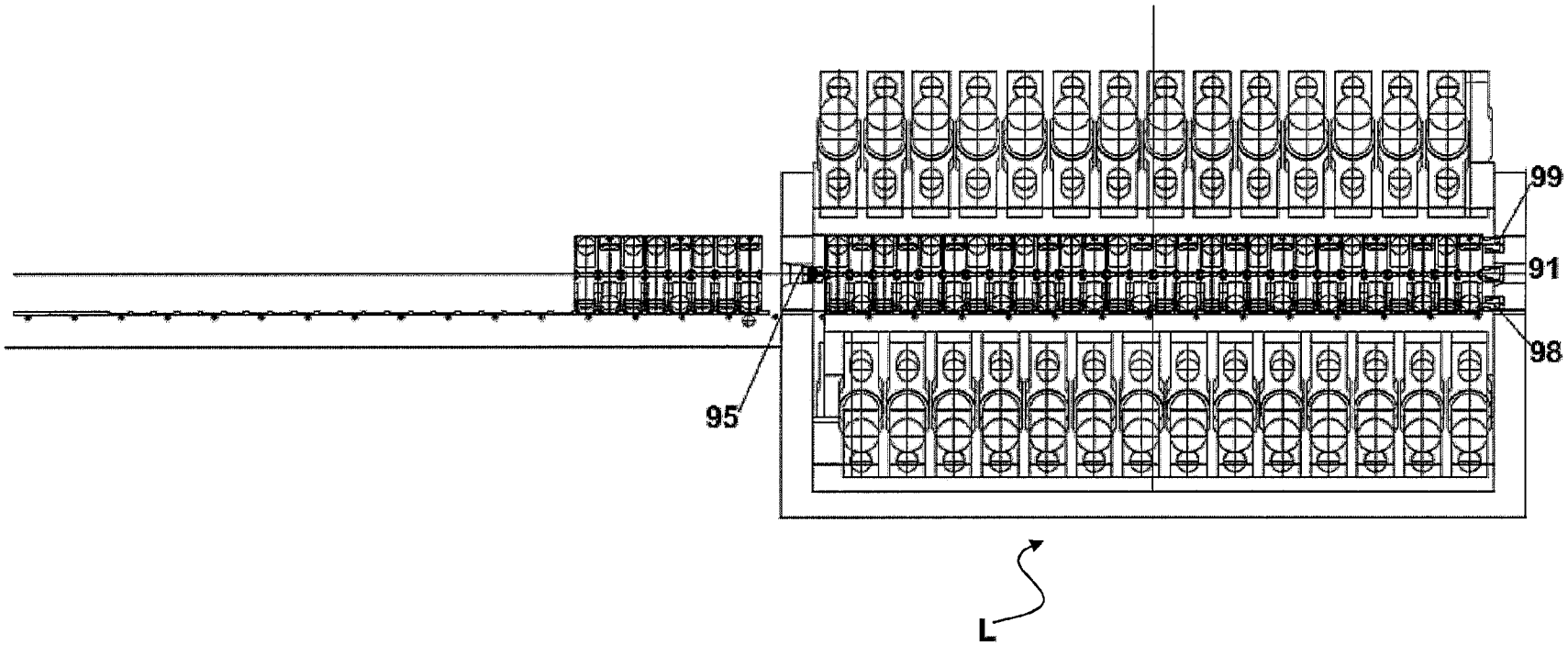
FIGS. 4 and 5 show side section and plan views, respectively, of a rolling mill in accordance with the invention.
Figure 5:
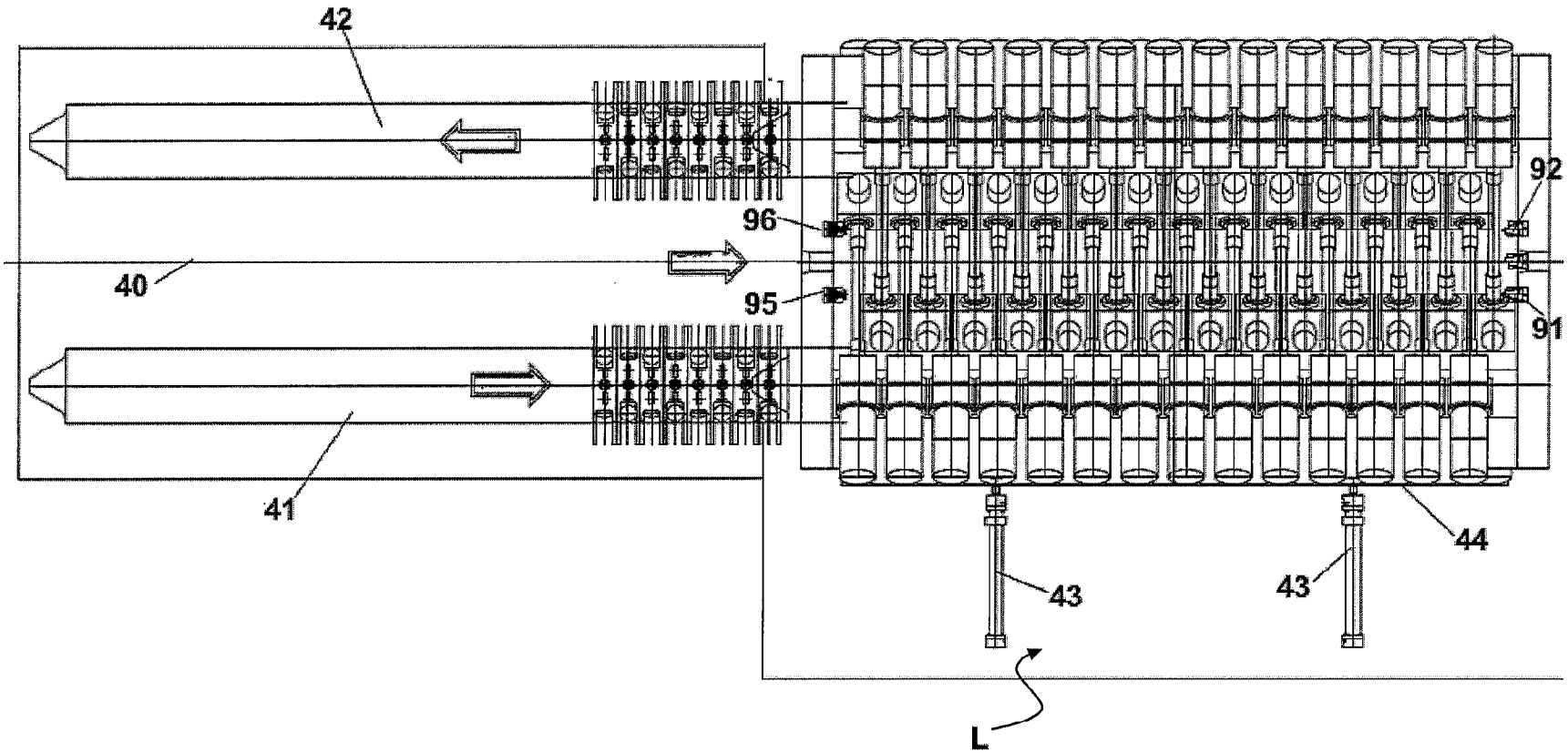
Figure 7A:
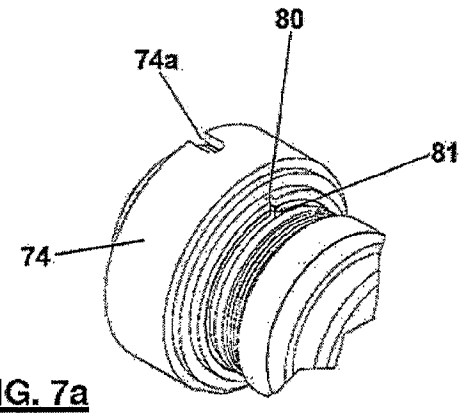
FIGS. 6*a*, 6*b*, 7*a*, 7*b* show constructional details of a control system of a roll in accordance with the invention.
Figure 7B:
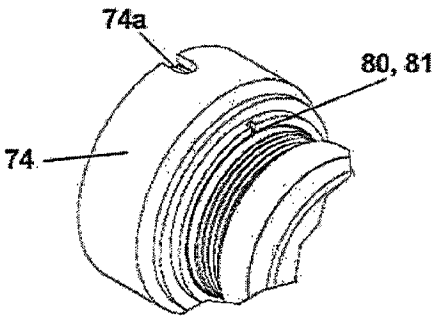

With particular reference to FIGS. 4 and 5, rolling mill L comprises a central body with a sequence of alternating stands of the above-described type, i.e. rotated by 180° with respect to the vertical axis.

The stand substituting system includes a direct, three-position side movement in which the central position 40 corresponds to the rolling mill axis. The arrow on the axis 40 indicates the rolling direction.

The new stands which should substitute the working ones are prepared on a platform 41 on a first side position of the rolling mill, also named charge side, aligned in positions corresponding to those that they will take after the insertion in the rolling mill.

Instead, the substituted stands will be automatically arranged on another platform 42 at a second side position, also named discharge side, on the opposite side of the rolling mill.

The stands which do not intervene in the substitution remain in place.

First, the spindles are unlocked and backed by taking them outside the profile of the stands.

It is worth noting that the spindles may also be individually unlocked. This increases the number of hydraulic control cylinders, one for each spindle, avoiding however the use of the longitudinal beams.

The platform 41 is then longitudinally translated, i.e. parallelly to the rolling axis (in the arrow direction on axis 41) from the charge side, so that the new stands are in correspondence to the stands to be substituted, by means of appropriate translation means, not shown in the figure because made in a known manner, operating in the arrow direction.

A common transversal translation device for all stands 43, 44 (also see FIG. 1) pushes the new stands towards the rolling mill axis, because the stands may slide on guiding slides 45 on which the lower sides thereof rest. A common device may consist of hydraulic systems 43 which push a longitudinal beam 44 against which the edges of the extensions 22 of the new stands are engaged.

The same new stands push the corresponding stands used out from the rolling mill onto the platform 42 on the discharge side, substantially by the interaction between the extensions 22, 22*b* of the lower side of the stands, thus placing them on the platform 42 on the discharge side.

Mobile devices 50 are further present and adapted to serve a mechanical reference stopping function for correctly place and lock the stands; when raised, they are engaged against the edge of the stand.

In an embodiment, the mobile devices are of the tilting type about a pin 51 and controlled by appropriate hydraulic systems 52. They are tipped (enlarged detail in FIG. 2) in order to allow the operation of substituting the stand.

These mobile devices 50, present in pairs on each stand, are alternatively up and down on the same side of two successive stands. They may be made in a different manner from the tilting manner, providing that they do not interfere with the stand during the substitution.

In order to create a space between the old stands, extracted from the discharge side, and the new stands in the operative position in the rolling mill, the old extracted stands are preferably firstly moved away from the new ones by a lever device 57 (enlarged detail in FIG. 1).

When the stand substituting operation is completed, the corresponding spindles are reconnected and the rolling process may resume immediately. Without interrupting the rolling process, the used stands are moved away and the stands needed for the subsequent substitution are charged close to the rolling mill by acting on the platforms 41 and 42.

Platform 42 on the discharge side is provided with suitable translation means, not shown in the figure because made in a known manner, which operate in the arrow direction for the longitudinal translation.

Evidently, constructional variants may be included in which either or both the platforms 41, 42 may move transversally and not longitudinally making in all cases approaching movement to the central body of the new stands and separating movements from the central body of the substituted stands without departing from the teaching of invention.

It is further worth noting that the machines according to the prior art include stand substitution on one side only and therefore the step of extracting the used stands and inserting the new stands may not be synchronized, as in the rolling mill according to the invention.

The advantages from the use of this stand substituting process are apparent. The overall system is small-sized and uses a few elements, with a very fast process of substituting the stands.

It is worth noting that the process is completely automatic, not being necessary the presence of manual operations, not even for locking the stands. They may also be raised and easily turned, e.g. on a crane carrier, by rotating about their vertical axis, to take even and odd positions in the rolling mill.

This symmetry feature is also important with regard to the roll turning process.

As mentioned above, a problem to be addressed is the need of turning the rolls to avoid the misalignment between successive rolls, in the boundary points between two rolls, because the gap between the two rolls is very small (e.g. 2 mm), thus even a minor misalignment (e.g. 0.2 mm), determines steps, dragging or scoring phenomena on the rod-shaped body.

Therefore, in order to solve this problem, profile continuity should be ensured between adjacent rolls: this may be carried out only by turning the rolls when they are mounted on the stand.

Thereby, the rolls may be turned by a special lathe adapted to turn the rolls mounted on the stand, because the rolls do not need to be removed from the stand, and even and odd stands, morphologically equivalent to one another, may be presented to the lathe by simply rotating them by 180° on the vertical axis.

With reference to FIGS. 2 (enlarged detail), 6*a*, 6*b*, 7*a*, 7*b*, the roll (e.g. roll 3 in FIG. 2) may be provided with an eccentric micrometric regulating system of the radial position with respect to the rolling axis.

Roll 3 is provided with bearings mounted inside eccentric bushings 71, 72 on the two sides thereof, one (72) on the control side and the other (71) on the opposite side. The two bushings are connected by a bridge 73 which rigidly connects them. In an embodiment, eccentricity ECC is ECC=5 mm, with a working angle of +/−15°, corresponding to a maximum variation of the radial position of the bottom gorge of the roll of about +/−1.25 mm, and corresponding to a maximum distance variation between two opposite rolls of about 5 mm.

From the control side of the roll, by means of a spring sleeve-shaped connection 74, there is an eccentric rotation control device 27, e.g. provided with a worm geared motor 75 or other irreversible or braked type.

The eccentrics of two adjacent shafts are connected by means of 90° conical toothed sectors, which allow to transmit the rotation from the eccentric (72) driven from the outside to the eccentric bushing of the adjacent shaft. The bridges 73 are provided on all rolls of a stand.

Figure 6A:
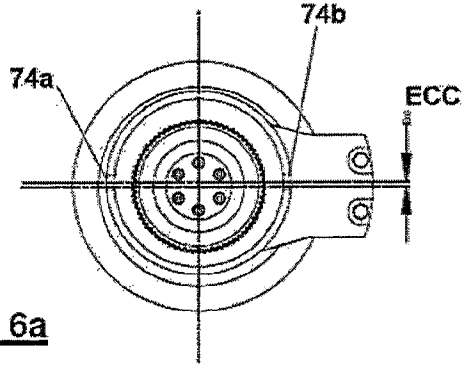
Figure 6B:
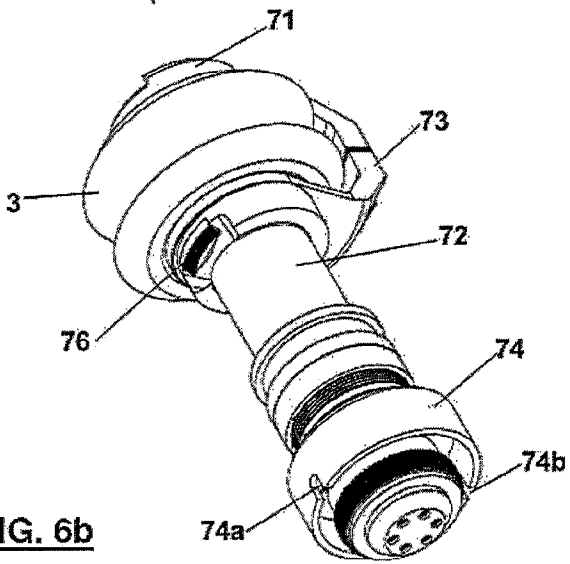
Figure 8:
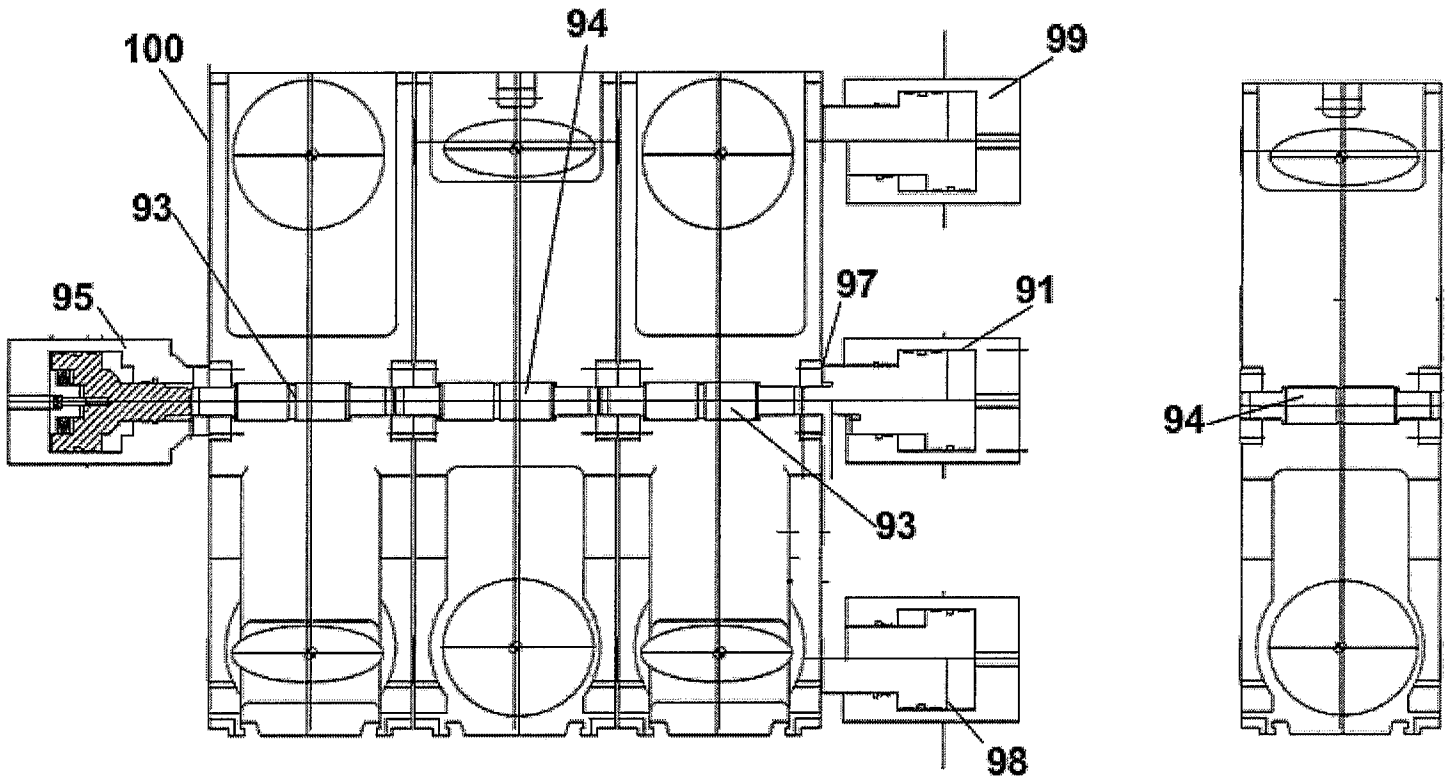
FIG. 8 shows a side section view of the packing system of the stands in the rolling mill in accordance with the invention.

For example, in roll 3 (FIG. 6*b*), the conical toothed sector is indicated by numeral 76, arranged on the control side, while there is an equivalent conical toothed sector on the adjacent roll 4, mounted on the eccentric bushing 71 on the opposite side.

Control 27 acts on the spring sleeve 74 by means of two feeding pins which are engaged in two hollows 74*a*, 74*b* present thereon.

Figure 10:
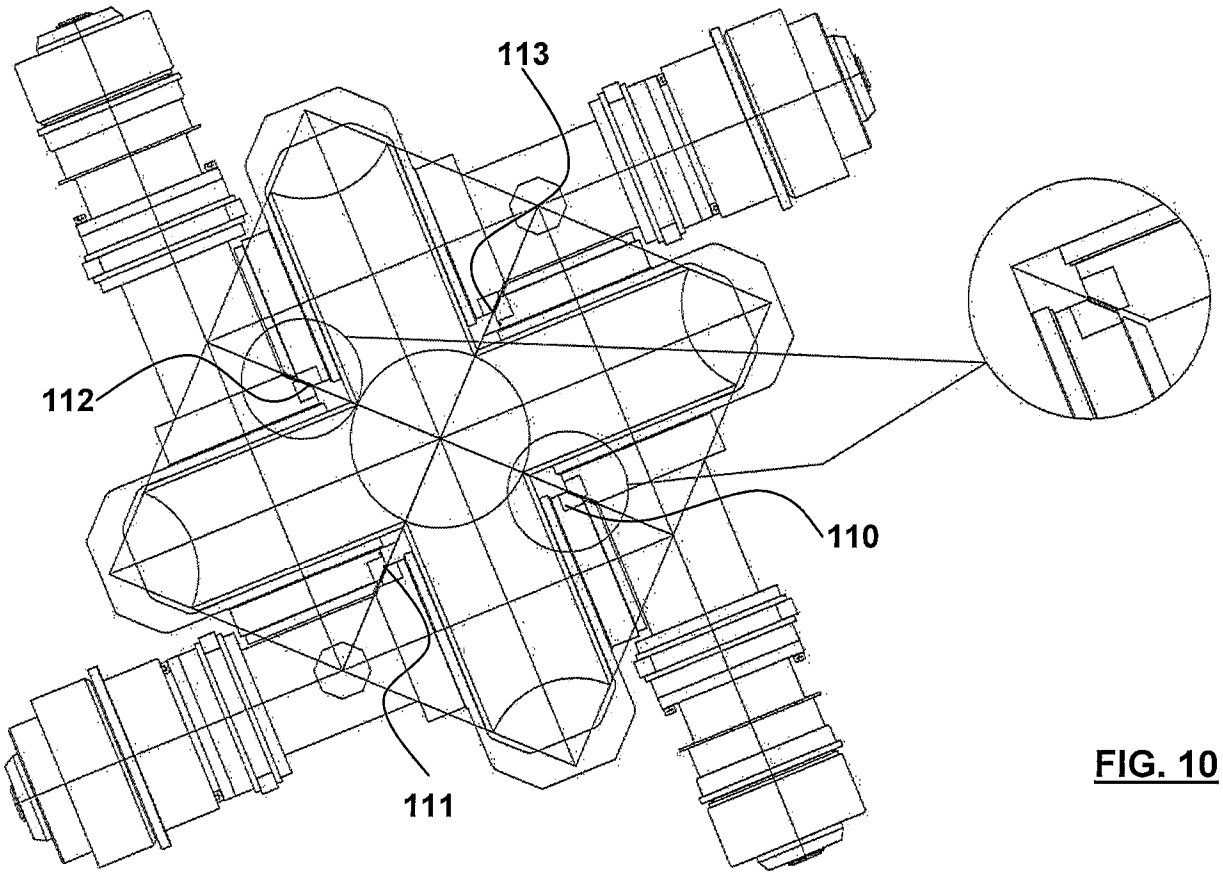
FIG. 10 shows a variant of the control system of the rolls.

FIG. 10 shows a variant of the control system of the rolls. For the transmission of the command of the eccentric regulation, preferably in each stand, four pairs of conical toothed sectors (110, 111, 112, 113) are added which mechanically couple all the eccentric bushings.

In a nominal position (e.g. with a working angle of 0°, and a zero radial movement value, but other angular eccentricity positions are possible), a lock device 81 is included which engages a flange integral with the stand body when the control is moved away from the stand. For example, the lock device comprises a pin 81 which engages a recess 80 obtained on the flange integral with the stand body.

That is, before substituting the stand, the eccentrics are taken back to said nominal position (zero radial movement value) and the spring sleeve control is moved away. In this position, the lock device is automatically engaged and the radial movement remains blocked at the normal value.

Therefore, the following two advantages are obtained when the stand is extracted: the stand is fixed and the position of the rolls under nominal conditions is known. This allows to turn with the special lathe on which the stands in nominal position are machined. Accordingly, the four rolls may be all machined in the same position, which is already the working position, thus ensuring that the rolls are all equally turned and with the same diameter.

The described solution ensures operative safety because the eccentrics of the rolls in a stand are mechanically blocked, when the stand is not in the rolling mill.

The procedure for taking the stands back to nominal position is fast and does not involve manual operations.

Fixed stands without eccentric adjustment, and adjustable stands with eccentric adjustment may coexist in the rolling mill. Fixed stands may be easily obtained from the design of the adjustable ones, by omitting the eccentrics and the spring sleeves.

For example, the roughing stands (input side of the rod-shaped body into the rolling mill) are fixed, while the finishing stands (normally, the last three stands of each series) may be adjustable.

We have described above how the stands transversally enter and exit from two opposite sides of the rolling mill, and thus still mechanical reference stoppers may not be used. For this purpose, tilting eccentric control devices are used, which have mechanical reference zones on which the stands rest.

In order to ensure the correct alignment and blocking of the stands, there are further devices described with reference to FIGS. 3, 4, 5, and 8.

In the stands aligned in the rolling mill, two hydraulic cylinders 91, 92 placed on the outlet side push two through floating pins 93, 94, present in each stand in the side position of the horizontal plane passing through the rolling axis. These male pins engage successive female seats in the successive stand. At the same time, the pins themselves push the pins of the successive stand to reach the opposite side of the rolling mill (input side), where two seats 95, 96 are provided for receiving the pins and where two further cylinders are also provided. The latter are adapted to impress a thrust in opposite direction to unlock the pins from the engaged seats during a stand substitution.

The alignment cylinders which push the pins into the arranged seats are shaped so that before reaching the travel end, a plate 97 acts on the fixed parts of the first stand and axially packs the whole train of stands.

Two further cylinders 98, 99 symmetrically arranged on a vertical axis passing through the rolling axis, contribute to axially pack all the stands.

A still mechanical reference stopper 100 ensuring the packing action by the pressure of the cylinders is present on the inlet side.

This solution is novel and allows to vertically and horizontally align two successive stands, and prevents from working with misaligned stands.

Figure 9:
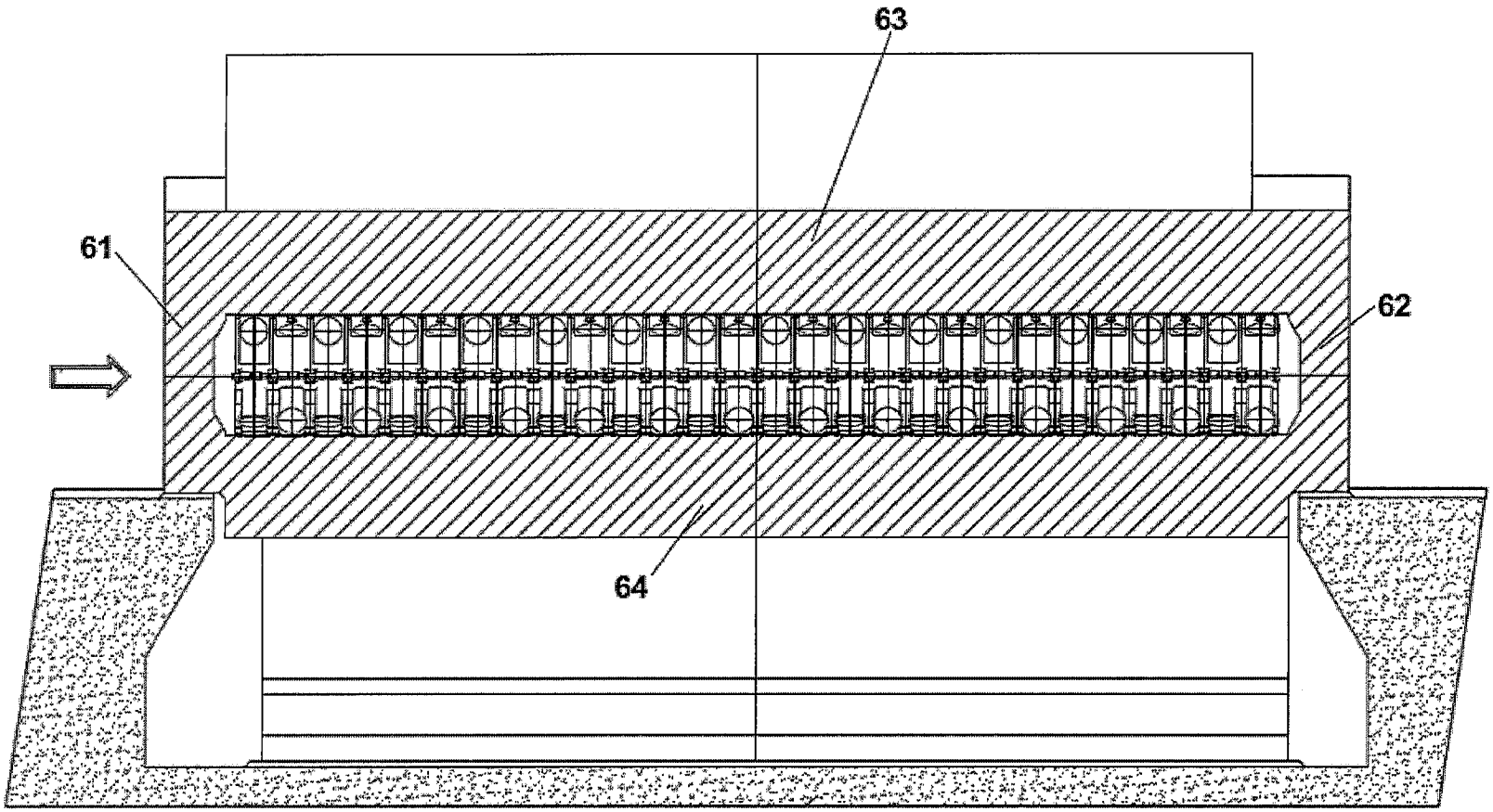
FIG. 9 shows a side section view of the supporting structure of the rolling mill in accordance with the invention.

With reference to FIG. 9, the supporting structure of the rolling mill is made to support the weight of the control and adjustment devices for the rolls of the stands.

Furthermore, the structure ensures holding the packing forces of the stands exerted by the cylinders 91, 92, 98, 99.

Advantageously, the structure is of the closed-loop type with two uprights, one on the inlet side 61 and one on the outlet side 62.

An upper bridge 63 supports the weight of the upper controls. A lower bridge 64 of the ring allows to relieve the forces to the ground.

It is worth nothing that in FIG. 9, devices 91, 92, 95, 96, 98, 99, 100 have been omitted because this figure is to clearly illustrate the annular structure concept.

Other possible constructional variants of the non-limitative example described are possible, without therefore departing from the scope of protection of the present invention, thus comprising all the equivalent implementations for a person skilled in the art.

From the above description, a person skilled in the art will be able to implement the object of the invention without introducing further constructional details.

The invention claimed is:

1. Multi-stand rolling mill of the longitudinal elongator kind, for rod-shaped bodies, comprising four-roll stands wherein said four rolls are motorized and provided with spindles, said rolling mill comprising:

a central body comprising a sequence of said stands for said rolling;

a first platform on a side charge position, carrying one or more substitution stands;

a second platform on a side discharge position, opposed to said side charge position with regard to the central body, said second platform being suitable to move said one or more stands to be substituted;

a transverse translation device acting on said one or more substitution stands to push them against corresponding stands to be substituted on the central body; said stands to be substituted moving on said second platform, and said one or more substitution stands substituting said one or more stands to be substituted in said central body; and an alignment and locking system of the stands comprising:

one or more floating pins passing in relative internal sets to each of said stands in an aligned position;

one or more hydraulic cylinders on a first side of the mill to push said floating pins in a first direction in each of said stands so that they are engage in the adjacent stand in order to obtain said alignment and locking;

one or more hydraulic cylinders on a second side of the rolling mill, opposite to said first side, to push said floating pins in a second direction, opposite to said first direction, and to bring them back inside said internal seats for unlocking the stands.

2. Multi-stand rolling mill according to claim 1, wherein a stand with a given position in the rolling mill is provided with a shape obtained by means of a 180° rotation with regard to the vertical axis of a preceding or successive stand, and wherein the bottom gorges of the rolls of a stand have a position corresponding to the roll gaps of the preceding or the successive stand.

3. Multi-stand rolling mill according to claim 1, comprising drives for the rolls external to the stand and retractile spindles, wherein:

the axis of each roll of as stand is rotated with an angle $\alpha 1=-22.5°$ if compared to the reference vertical or horizontal axis, whereas the axis of each roll of the successive stand is rotated with an opposed angle $\alpha 2=22.5°$;

said external roll drives and said retractile spindles are arranged on corresponding our rows having said $\alpha 1$ and $\alpha 2$ angles with regard to the horizontal plane on successive stands;

the four rolls are coplanar in each stand.

4. Multi-stand rolling mill according to claim 2, comprising dr for the rolls external to the stand and retractile spindles, wherein:

the axis of each roll of a stand is rotated with an angle $\alpha 1=-22.5°$ if compared to the reference vertical or horizontal axis, whereas the axis of each roll of the successive stand is rotated with an opposed angle $\alpha 2=22.5°$;

said external roll drives and said retractile spindles are arranged on corresponding four rows having said $\alpha 1$ and $\alpha 2$ angles with regard to the horizontal plane on successive stands;

the four rolls are coplanar in each stand.

5. Multi-stand roiling mill according to claim 3 or 4, wherein for each stand said external drives comprise two motors, each for two adjacent rolls, each motor transmitting its motion to the two adjacent rolls by means of intermediate devices of motion transmission acting on said retractile spindles.

6. Multi-stand rolling mill according to claim 1, comprising:

longitudinal beams, one for each row of spindles arranged with the same angle on alternating stands, the external ends of said spindles being connected to said beams;

hydraulic drives on said longitudinal beams to actuate the backing of the spindles, so that the end of the spindle close to the rolls protrudes from the edge of the stand.

7. Multi-stand roiling mill according to claim 1 comprising hydraulic drives directly on the spindles, to actuate the hacking of the spindles, so that the end of the spindle close to the rolls protrudes from the edge of the stand.

8. Multi-stand rolling mill according to claim 1, wherein one or more of said rolls comprise an eccentric micrometric regulating system of the roll radial position, said eccentric system comprising means for the engagement in a given eccentricity position, operating when the stand is substituted.

9. Multi-stand rolling mill according to claim 1 further comprising a mobile device for each stand, placed on the discharge side, in order to provide for a mechanical reference stop for the stand lock, and to be removed at each stand substitution.

10. Multi-stand roiling mill according to claim 1, comprising a lever device for each stand, to remove said stand to be substituted from the central body after said stand substitution.

11. Multi-stand rolling mill according to claim 1, further comprising:

one or more further cylinders on said first side of the rolling mill to push against the stands of the central body for the axial packing of the stands;

a still mechanical reference stopper on said opposite side of the rolling mill for said axial packing.

12. Multi-stand rolling mill according aim 1, comprising a supporting structure of a closed annular kind.

13. Method for substituting the stands in a multi-stand rolling mill according to claim 1, comprising the steps of:

prearranging on said first platform said one or more substitution stands, in correspondence to one or more stands to be substituted on the central body;

unlocking said spindles and backing them so that the end part close to the rolls protrudes from the edge of the corresponding stand;

transversally translating said one or more substitution stands pushing them against said one or more stands to be substituted, so that said one or more substitution stands are placed on said second platform and said one or more substitution stands are placed in the central body;

locking again said spindles, thus restarting the rolling process.

14. Method for substituting the stands according to claim 13, comprising an approaching step to said central body of said substitution stands on said first platform.

15. Method for substituting the stands according to claim 13, comprising the step of removal of said stands to be substituted by moving away from said central body on said second platform.

16. Multi-stand rolling mill of the longitudinal elongator kind, for rod shaped bodies, comprising four-roll stands, said roiling mill comprising:

a central body comprising a sequence of said stands for said rolling;

a lust platform on a side charge position, carrying one or more substitution stands;

a second platform on a side discharge position, opposed to said side charge position with regard to the central body, said second platform being suitable to move said one or more stands to be substituted; and a transverse translation device acting on said one or more substitution stands to push them against corresponding stands to be substituted on the central body: said stands to be substituted moving on said second platform, and said one or more substitution stands substituting said one or more stands to be substituted in said central body, wherein said four rolls are motorized by means of drives and provided with retractile spindles, wherein for each stand said drives comprise two motors, each motor for two adjacent rolls, each motor transmitting its motion to the two adjacent rolls by means of intermediate devices of motion transmission acting on said retractile spindles.

* * * * *